United States Patent [19]

Robideau et al.

[11] 4,238,170

[45] Dec. 9, 1980

[54] BLADE TIP SEAL FOR AN AXIAL FLOW ROTARY MACHINE

[75] Inventors: Brian A. Robideau; Juri Niiler, both of Glastonbury, Conn.

[73] Assignee: United Technologies Corporation, Hartford, Conn.

[21] Appl. No.: 919,185

[22] Filed: Jun. 26, 1978

[51] Int. Cl.[2] ..... F10D 11/08

[52] U.S. Cl. ..... 415/172 A; 415/217

[58] Field of Search ..... 415/119, 170 R, 172 R, 415/172 A, 174, 199.5, DIG. 1, 213 C, 216, 217; 60/221

[56] References Cited

U.S. PATENT DOCUMENTS

| | | | |
|---|---|---|---|
| 591,822 | 10/1897 | Curtis | 415/199.5 |
| 1,141,473 | 6/1915 | Metten | 415/199.5 |
| 2,435,236 | 2/1948 | Redding | 415/213 C |
| 2,847,941 | 8/1958 | Jackson | 415/213 C |
| 3,011,762 | 12/1961 | Pouit | 415/172 A |
| 3,680,977 | 8/1972 | Rabouyt et al. | 415/172 A |
| 3,934,410 | 1/1976 | Williams | 415/DIG. 1 |

FOREIGN PATENT DOCUMENTS

| | | | |
|---|---|---|---|
| 52778 | 7/1910 | Switzerland | 415/119 |
| 189457 | 3/1923 | United Kingdom | 415/199.5 |

*Primary Examiner*—Louis J. Casaregola

*Attorney, Agent, or Firm*—Robert C. Walker

[57] ABSTRACT

An airfoil tip seal structure for an axial flow rotary machine is disclosed. Various concepts relating to seal designs and their influence on tip sealing effectiveness are discussed. In accordance with the teaching contained herein, one seal geometry includes a circumferentially extending groove in the stator which circumscribes the tips of the blades of a corresponding rotor stage. Another seal geometry applicable to machines having cantilevered stator vanes includes a circumferentially extending groove in the rotor which circumscribes the tips of the vanes of a corresponding stator stage. The tips of the blades and the tips of the cantilevered stator vanes run over the corresponding groove in line on line relationship with the adjacent flow path wall at the design operating condition of the machine in which the seal structure is incorporated.

6 Claims, 6 Drawing Figures

FIG. 2C

FIG. 1
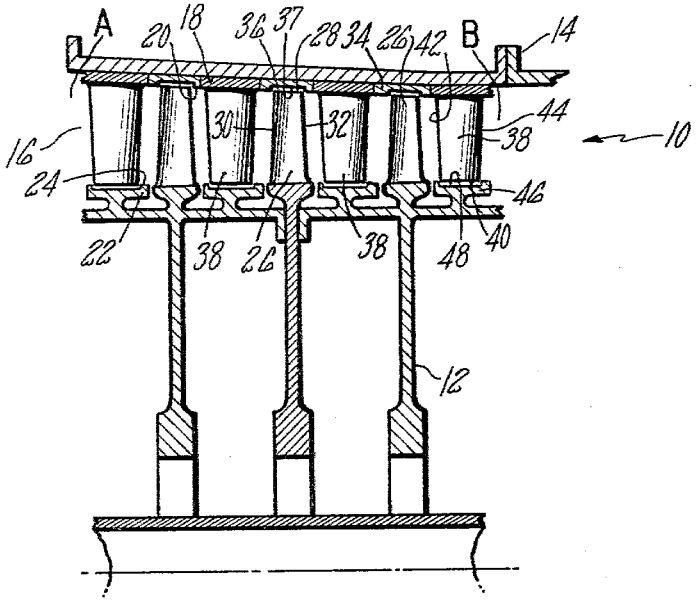
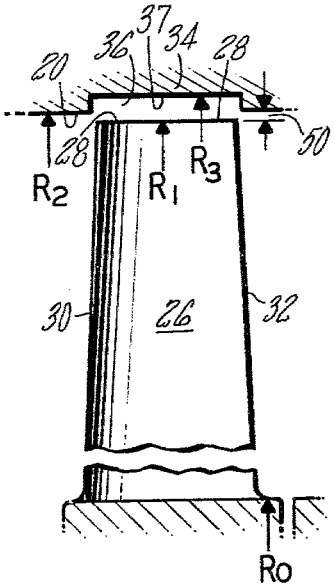
FIG. 2A
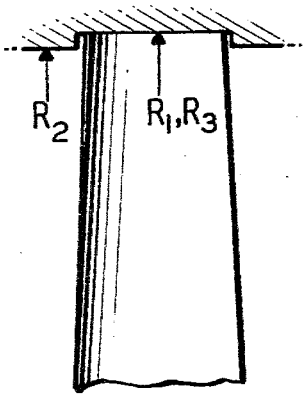
FIG. 2B
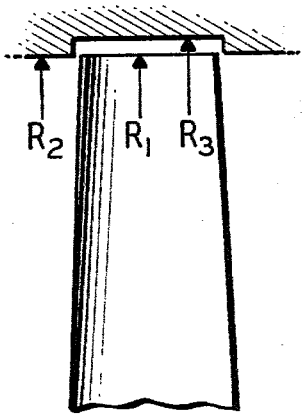
FIG. 2C

BLADE TIP SEAL FOR AN AXIAL FLOW ROTARY MACHINE

BACKGROUND OF THE INVENTION

1. Field of the Invention

This invention relates to axial flow rotary machines, and more particularly to an air seal between the tips of the machine airfoils and circumscribing portions of the flow path wall.

2. Description of the Prior Art

The concepts of the present invention are described with respect to a compressor embodiment thereof in a gas turbine engine. In such a compressor a plurality of rows of rotor blades extend radially outward from a rotor shaft across a flow path for the working medium gases. Collaterally, a plurality of rows of stator vanes extend radially inward across the flow path from a stator case. In some embodiments the stator vanes are cantilevered inwardly from the stator case. Each row of stator vanes is positioned to direct the medium gases into or away from an adjacent row of rotor blades. A stator seal land extends from the stator case to circumscribe the tips of the blades of each blade row. In cantilevered vane embodiments a rotor seal land extends from the rotor to circumscribe the tips of the vanes of each vane row.

The aerodynamic efficiency of the compressor is largely dependent upon the clearance between the tips of each row and the corresponding seal land. As the clearance is increased, substantial amounts of working medium gases leak circumferentially over the tips of the airfoils from the pressure sides to the suction sides of the airfoils. Additionally, amounts of medium gases leak axially over the tips from the downstream end to the upstream end of the airfoils.

The historic approach in controlling leakage has been to minimize the clearance dimension between the tips and the corresponding seal land at the design operating condition. Such, however, is not an easy task as during operation of the machine the relative radial growths between the tips and the corresponding seal lands are substantial. For example, as the rotor is turned to speed, thermal expansion of the rotor materials and centrifugally generated forces cause the tips of the rotor blades to be displaced radially outward toward the corresponding stator seal land. Sufficient initial clearance between the tips and the seal land must be provided to prevent destructive interference during this initial period. As thermal equilibrium is reached the stator seal land grows radially away from the blade tips to produce a resultant and undesirable clearance gap. Corresponding effects occur in cantilevered stator designs.

In an effort to avoid unduly large initial clearances many modern engines utilize abradable seal lands in which the airfoil tips are allowed to wear into the lands during transient excursions. U.S. Pat. Nos. 3,519,282 to Davis entitled "Abradable Material Seal"; 3,817,719 to Schilke et al entitled "High Temperature Abradable Material and Method of Preparing the Same"; 3,843,278 to Torell entitled "Abradable Seal Construction"; and 3,918,925 entitled "Abradable Seal" are representative of such seals and their methods of manufacture. Accordingly, by such embodiments the clearance over the airfoil tips becomes the minimum clearance that will accommodate rotor excursions.

Other techniques for reducing leakage across the blade tips have been investigated. One such technique relevant to the presently disclosed concepts is reported in NASA Technical Memorandum X-472 by Kofskey entitled "Experimental Investigation of Three Tip-Clearance Configurations Over a Range of Tip Clearance Using a Single-Stage Turbine of High Hub to Tip-Radius Ratio". Specifically, the "recessed casing" reported in the memorandum and illustrated in FIG. 3(*b*) is of interest. In accordance with the Kofskey teaching improved efficiency over conventional, smooth wall seals is obtainable by submerging the tips of turbine blades into a recess in the corresponding seal land. A comparison of smooth wall and recessed casing efficiencies is shown in FIG. 8 of Kofskey. Also shown in Kofskey is a comparison in FIG. 6 between a recessed casing in which the blade tips are submerged and a recessed casing in which the blade tips run line on line with the flow path wall. The tests show the submerged construction to be markedly superior by several percentage points in efficiency.

As energy costs continue to soar, manufacturers of rotary machines are devoting substantial resources to the improvement of machine efficiencies. It is against this background that the present inventive concepts were developed.

SUMMARY OF THE INVENTION

The primary aim of the present invention is to improve the aerodynamic efficiency across a compression stage in an axial flow compressor. A reduction in the leakage of working medium gases across the tips of the airfoil blades is sought and one specific object is to avoid windage losses in the tip region between the airfoils and a circumscribing seal land.

According to the present invention, the compressor of an axial flow machine includes a plurality of rotor blades which extend radially into line on line proximity with the outer wall of the working medium flow path at the design operating condition. In further accordance with the present invention, a circumferentially extending groove in a seal land circumscribing the blade tips accommodates relative thermal growth between the blade tips and the outer wall under transient conditions.

In accordance with another aspect of the invention which is applicable to machines employing cantilevered stator vanes, a plurality of said cantilevered vanes extend radially inward into line on line proximity with the inner wall of the working medium flow path and a circumferentially extending groove in a seal land circumscribing the vane tips accommodates relative thermal growth between the vane tips and the inner wall under transient conditions.

A primary feature of the present invention is the line on line proximity of the tips of the airfoils to the flow path wall at the cruise condition. Another feature is the groove in the corresponding seal land over the airfoil tips.

A principal advantage of the present invention is improved aerodynamic efficiency enabled by allowing the airfoils to extend over the full height of the fluid flow path. Structural interference between the tips of the airfoils and the circumscribing seal lands is avoided by providing a recess in the seal land over the tips. Windage losses are avoided by running the tips line on line with the flow path wall at the cruise condition rather than submerging the tips of the airfoils into the grooves in the seal lands.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a section view taken through the compressor section of a rotary machine showing circumferential grooves in the stator lands and circumferential grooves in the rotor lands;

FIG. 2A is an enlarged view of the blade tip region of the compressor illustrated in FIG. 1 under cold conditions;

FIG. 2B is an enlarged view of the blade tip region of the compressor illustrated in FIG. 1 at the pinch point condition;

FIG. 2C is an enlarged view of the blade tip region of the compressor illustrated in FIG. 1 under the design operating condition;

DETAILED DESCRIPTION

Figure 3:
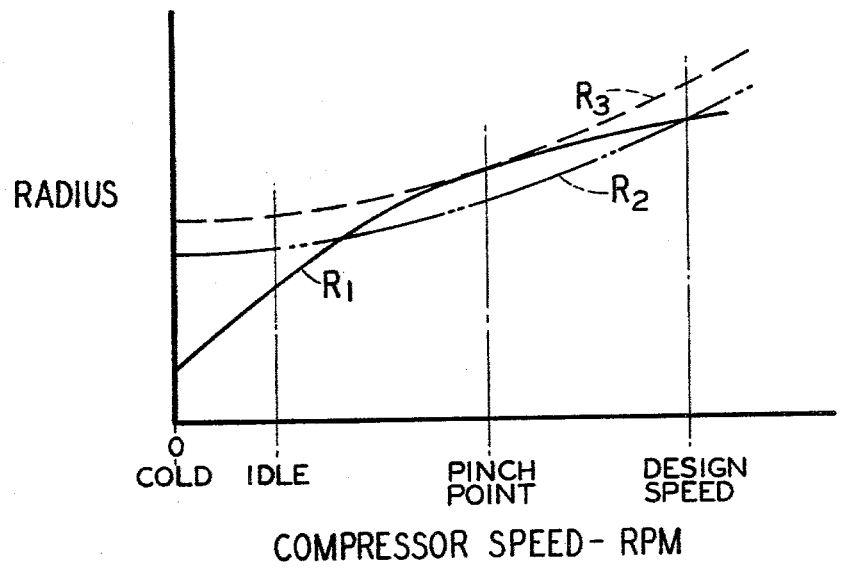
FIG. 3 is a graph illustrating the radial relationship between the blade tips and the circumscribing outer wall of the machine flow path.

A portion of a compression section 10 of an axial flow rotary machine having a rotor 12 and a stator 14 is illustrated in FIG. 1. A flow path 16 for working medium gases extends axially through the compression section. An outer wall 18 having an inwardly facing surface 20 and an inner wall 22 having an outwardly facing surface 24 form the flow path. A plurality of rows of rotor blades as represented by the single blades 26 extend outwardly from the rotor across the flow path into proximity with the outer wall. Each blade has an unshrouded tip 28 and is contoured to an airfoil cross section. Accordingly, each blade has a pressure side and a suction side and, as illustrated, has an upstream end 30 and a downstream end 32. Extending over the tips of each row of rotor blades is a stator seal land 34. Each land has a circumferentially extending groove 36 formed therein to a depth D at an inwardly facing surface 37 thereof.

A plurality of rows of stator vanes as represented by the single vanes 38 are cantilevered inwardly from the stator across the flow path into proximity with the inner wall. Each vane has an unshrouded tip 40 and is contoured to an airfoil section. Accordingly, each blade has a pressure side and a suction side and, as illustrated, has an upstream end 42 and a downstream end 44. Extending over the tips of each row of stator vanes is a rotor seal land 46. Each land has a circumferentially extending groove 48 formed therein.

As is illustrated in FIG. 2, the outwardly facing surface 24 of the inner wall 22 is at a distance $R_0$ from the axis of the machine. The tip 28 of each blade 26 is at a distance $R_1$ from the axis of the machine. The inwardly facing surface 20 of the outer wall 18 is at a distance $R_2$ from the axis of the machine. The bottom or inwardly facing surface of each groove 36 is at a distance $R_3$ from the axis of the machine.

In the cold condition the blade tips 26 and the inwardly facing surface 20 bear the relationship illustrated in FIG. 2A. The cold gap 50 between tips and surface enables assembly of the components. In response to centrifugally and thermally generated forces as the machine is accelerated though idle toward the design speed, the rotor tips grow radially outward into the groove 36 in the stator seal land 34. The point of closest proximity of the blades to the bottom of the groove is referred to as the "pinch point". As the design speed is reached the outer wall including the seal land, grows radially away from the blade tips to a position at which the distance $R_2$ to the inwardly facing surface 20 of the outer wall and the distance $R_1$ to the blade tips is equal.

The initial distance $R_1$ and $R_2$ are provided such that the blade tips and the inwardly facing surface reach an equivalent radius at the design condition. The initial distance $R_3$ is such as will accommodate excursion of the blade tips into the seal land at the pinch point condition. The FIG. 3 graph illustrates the relationship between the radii $R_1$, $R_2$ and $R_3$ over operating conditions of the machine. For example, the design operating condition of an aircraft gas turbine engine may be the cruise condition.

Construction of a compressor in accordance with the above teaching enables the machine to achieve improved aerodynamic efficiency in the blade tip region. To varify the efficiency gain, the adiabatic efficiency across a three stage compression apparatus was determined experimentally under three seal forming conditions: smooth wall; line on line over a groove; and tip submerged into a groove. Referring to FIG. 1 instrumentation was disposed at location A to measure the total pressure ($P_{TA}$) and total temperature ($T_{TA}$) of the working medium gas flowing into the compression apparatus and at location B to measure the total pressure ($P_{TB}$) and total temperature ($T_{TB}$) of the working medium gas flowing out of the compression apparatus. Numerous measurements were taken at various initial clearance dimensions between the tips and the corresponding wall (including the groove in such grooved embodiments). Adiabatic efficiency ($\eta ad$) was calculated at each point in accordance with the known formula shown below:

$$\eta ad = \left[\left(\frac{P_{TB}}{P_{TA}}\right)^{\frac{\gamma-1}{\gamma}} - 1\right] \Big/ \left[\left(\frac{T_{TB}}{T_{TA}}\right) - 1\right]$$

where $\gamma$ is $c_p/c_v$;

$c_p$ is the specific heat of air at constant pressure;

$c_v$ is the specific heat of air at constant volume;

$P_{TA}$ is the total pressure at the inlet;

$P_{TB}$ is the total pressure at the outlet;

$T_{TA}$ is the total temperature at the inlet; and $T_{TB}$ is the total temperature at the outlet.

Figure 4:
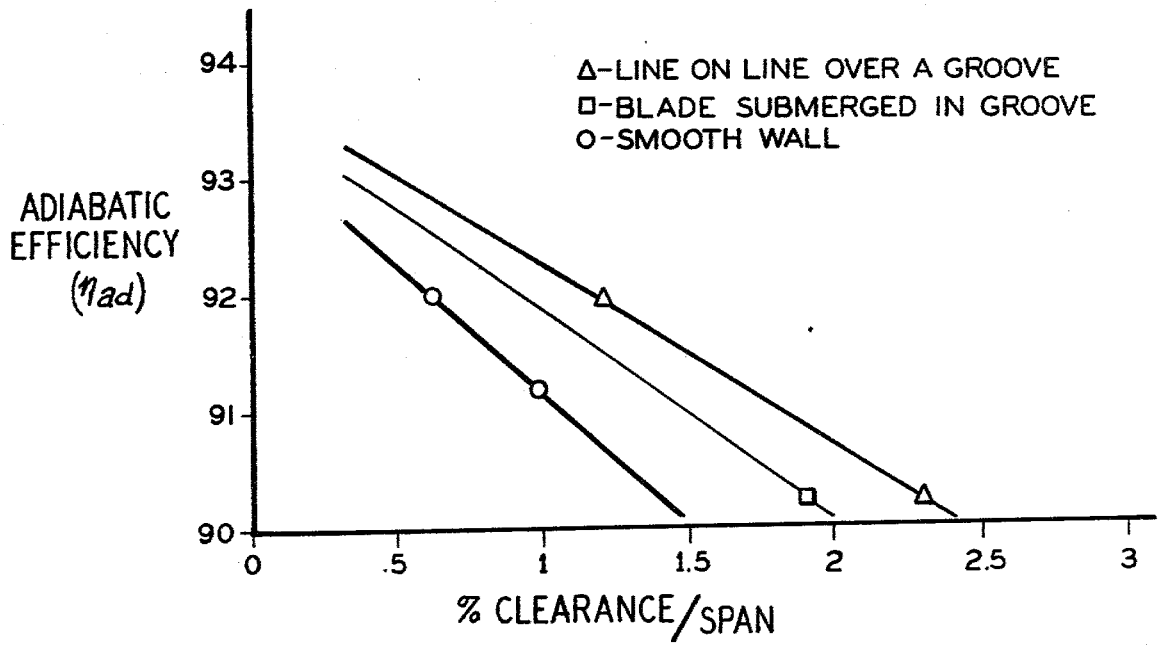
FIG. 4 is a graph comparing the adiabatic efficiency of a three stage rotary machine operating with smooth wall stator lands, grooved stator lands, and grooved stator lands with submerged rotor blade tips.

Adiabatic efficiency for each of the three sets of apparatus tested is plotted against the clearance at design condition between the tips and the opposing wall (including the groove in such embodiments) as a percentage of the span of the blades in the FIG. 4 graph. The span S of the blades is equal to the distance $R_0$–$R_2$. Clearance C at the design condition is equal to the distance $R_3$–$R_1$ and ranges between one-half to two and one-half percent (0.5–2.5%) of span for blades of an approximate one (1) inch span in the embodiments tested. Accordingly, the clearances C ranged from approximately five thousandths (0.005) of an inch to twenty five thousandths (0.025) of an inch.

The specific data points taken in the development of the FIG. 4 graph are shown below:

| Engine Build | Type | Clearance (C) | Adiabatic Efficiency ($\eta$ ad) |
|---|---|---|---|
| A | line on line over groove | 1.2% S | 92.0% |
| B | line on line over groove | 2.3% S | 90.3% |
| C | smooth wall | 0.6% S | 92.0% |
| D | smooth wall | 1.0% S | 91.2% |
| E | submerged tip (1% S submerged) | 1.9% S | 90.3% |

In practice of the invention the grooves 36 may be initially formed to the clearance C such that the blade tips refrain from striking the seal land. In other embodiments the seal land is formed of an abradable material such that the blade tips themselves wear a groove of appropriate depth into the land at the pinch point condition. In both types of embodiments, however, it is critical that the blade tips retract from the corresponding groove to line on line relationship with the inwardly facing surface of the outer wall.

The design and operation of a stator vane tip/rotor seal land embodiment of the invention corresponds to that described with respect to the rotor blade tip/stator seal land embodiment above. Both embodiments may be incorporated in the same machine.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. In an axial flow rotary machine of the type having a rotor adapted for rotation about the axis of the machine at a design condition and a stator encasing said rotor to form a compression section through which a working medium gas is flowable, wherein an annular flow path for the working medium gas is formed between an outer wall on the stator and an inner wall on the rotor, the improvement comprising: a compressor stator vane disposed radially across the flow path wherein said vane has an unshrouded tip; and an inner flow path wall on the rotor having a surface facing the flow path wherein the wall has a circumferentially extending groove recessed from said surface under said tip such that at the design condition the tip and the surface are spaced equal distances from the axis of the machine.

2. In an axial flow rotary machine of the type having a rotor adapted for rotation about an axis at a design condition and a stator encasing said rotor to form a compression section through which a working medium gas is flowable, wherein a flow path for the working medium gas is formed between an outer wall on the stator and an inner wall on the rotor, the improvement comprising:

at least one row of compressor rotor blades extending from the rotor into proximity with the outer wall wherein each blade has an unshrouded tip spaced at a radius $R_1$ from the axis of the machine;

an inwardly facing surface on the outer wall at a radius $R_2$ from the axis of the machine where at the design condition of the machine the radii $R_1$ and $R_2$ are equal; and a seal land at the outer wall wherein the seal land has a circumferentially extending groove which circumscribes the tips of said rotor blades.

3. The invention according to claim 2 wherein the inner wall of the flow path has an outwardly facing surface at a radius $R_0$ from the axis of the machine, wherein each blade has a span S which is equal to the distance between the opposing surfaces of the flow path walls ($R_2$–$R_0$), wherein the groove has an inwardly facing surface at a radius $R_3$ from the axis of the engine, and further wherein the depth D of the groove is within the range of five tenths of one percent (0.5%) to two and one half percent (2.5%) of the span S of the blade.

4. The invention according to claim 3 wherein the depth of the groove D is equal to the distance $R_3$–$R_2$ at the design condition.

5. The invention according to claim 4 wherein the rotary machine is an aircraft gas turbine engine and wherein the design condition is the engine cruise condition.

6. The invention according to claim 2 which further includes:

at least one row of stator vanes cantilevered from the outer wall of the stator and having unshrouded stator tips extending into proximity with the inner wall on the rotor;

an outwardly facing surface on the outer wall spaced from the axis of the machine at a distance such that at the design condition the distance from the stator tips to the axis and from the inner surface to the axis are equal; and a seal land at the inner wall wherein the seal land has a circumferentially extending groove which circumscribes the tips of said stator vanes.

* * * * *